United States Patent [19]

Suttmeier

[11] Patent Number: 4,960,397

[45] Date of Patent: Oct. 2, 1990

[54] VARIABLE PITCH PROPELLER ASSEMBLY

[76] Inventor: Robert F. Suttmeier, Box 77, Vernal Butler Rd., Purling, N.Y. 12470

[21] Appl. No.: 228,453

[22] Filed: Aug. 5, 1988

[51] Int. Cl.[5] ..... B63H 3/00

[52] U.S. Cl. ..... 440/050; 416/164

[58] Field of Search ..... 440/49, 50; 416/120, 416/121, '127, 131, 133, 136, 138, 147, 153, 154, 159, 164, 168 R

[56] References Cited

U.S. PATENT DOCUMENTS

| | | | |
|---|---|---|---|
| 571,745 | 11/1896 | Brinkman . | |
| 648,352 | 4/1900 | Blanton | 416/244 B |
| 649,781 | 5/1900 | Voltor . | |
| 663,185 | 12/1900 | Otto . | |
| 718,881 | 1/1903 | Sarr . | |
| 1,144,521 | 6/1915 | Barrows | 416/127 |
| 1,816,730 | 7/1931 | Hardin | 416/168 |
| 1,826,021 | 10/1931 | Randall | 416/168 |
| 2,742,097 | 4/1956 | Gaston | 440/50 |
| 2,767,036 | 10/1956 | Byron | 416/168 |
| 3,092,186 | 6/1963 | MacLean . | |
| 3,266,454 | 8/1966 | Sterling et al. . | |
| 3,552,348 | 1/1971 | Shima | 440/50 |

FOREIGN PATENT DOCUMENTS

| | | | |
|---|---|---|---|
| 176542 | 9/1961 | Sweden | 416/168 |
| 119864 | 4/1927 | Switzerland | 416/164 |

*Primary Examiner*—Sherman Basinger

*Assistant Examiner*—Jesûs D. Sotelo

*Attorney, Agent, or Firm*—Heslin & Rothenberg

[57] ABSTRACT

A variable pitch propeller assembly includes a hollow casing which, at its inner surface, fits securely around the propeller shaft. The outer surface of the casing forms the general shape of a cylinder which is coaxially located with respect to the propeller shaft's axis of rotation. A hollow collar is disposed around the outer surface of at least a portion of the casing and is further configured for movement with respect to the casing along the casing's longitudinal axis. A plurality of propeller blades are arranged around the outer circumference of the casing, and are connected to the casing so that the pitch of each blade with respect to the axis of rotation of the propeller shaft is varied by rotation of the blade about an axis which extends generally perpendicularly from the outer surface of the casing. Each propeller blade is also connected to the collar so that axial movement of the collar with respect to the casing produces the same amount of rotational movement for each blade about its associated perpendicular axis. In one embodiment, each blade is connected to the collar by a connecting link which is hingedly attached at one end to the collar and similarly attached at the other end to the blade. Movement of the collar with respect to the casing, and correspondingly, the pitch of the propeller blades, may be conveniently controlled by a hydraulic cylinder which is connected by a fulcrumed lever to a thrust bearing attached to the collar.

16 Claims, 3 Drawing Sheets

VARIABLE PITCH PROPELLER ASSEMBLY

Field of the Invention

This invention relates to a propeller assembly for which the pitch can be varied while the propeller is in operation. More particularly, it relates to an improved mechanism for varying the pitch of a propeller assembly using components and linkages which are confined to the propeller assembly itself and which do not affect the source of power for driving the propeller. In one embodiment, the invention is especially useful for marine propulsion.

Background of the Invention

In marine transportation, the desired speed for propelling a boat through the water varies according to the function being performed, as well as with water conditions, weight distribution of the load within the boat, and a number of other factors. For example, a very slow speed is desired when trolling or docking. At other times, high speeds are required. However, for propellers having a fixed pitch, very high or very low speeds are often not attainable or easily sustainable for a particular marine motor. The pitch of a propeller is often chosen to provide a compromise between the desired performance at slow speed and the desired performance at high speed.

Moreover, particularly for outboard motors, the optimum propeller pitch for getting a boat underway from a stopped position is considerably lower than the optimum pitch for cruising once the boat has "planed" on top of the water. It is well known that the efficiency of a marine motor can be improved considerably by matching the pitch or angle of attack of the propeller blade to the motor's operating conditions. Doing so provides more precise control of the boat speed, as well as increasing engine life. Hence, a variable pitch propeller would allow a boat to be operated efficiently over a range of boat speeds, using a constant engine speed. For all boat speeds, the engine speed could be chosen to more closely match the speed which provides maximum engine performance and operating life.

Others have recognized the advantages of a variable pitch propeller mechanism, and several attempts have been made in the past to provide this function. However, none of them have been particularly successful, as evidenced by the fact that a practical variable pitch propeller is still not commercially available. Many of the previous attempts to solve this problem require modifications to the engine drive mechanism in order to vary the pitch of the propeller. Furthermore, many of the mechanisms proposed present problems of their own in either their manufacture or their operation. Patents which disclose previous attempts at providing a variable pitch propeller, but which suffer from the types of problems described above, include U.S. Pat. Nos. 571,745, issued Nov. 24, 1896 to Brinkmann, 663,185, issued Dec. 4, 1900 to Otto, 2,742,097, issued Apr. 17, 1956 to Gaston, 3,092,186, issued June 4, 1963 to MacLean, and 3,266,454, issued Aug. 16, 1966 to Sterling et al.

Another problem with conventional propellers, besides being of fixed pitch, is that the entire propeller must often be discarded when one of the propeller blades is damaged. If one of the blades is severely bent or broken, repair of that blade is often not feasible. Since the blades of conventional propellers are permanently attached to the rest of the propeller structure, replacement of the damaged blade is not possible and the entire unit is rendered unusable.

Accordingly, a primary object of the present invention is to provide a variable pitch propeller assembly which can be utilized with conventional marine drive shafts without any significant modifications to the motor's drive unit.

It is another object of the present invention to provide a means for varying the pitch of a propeller while the propeller is in operation, in order to obtain satisfactory performance at both high and low speeds while maintaining efficient engine operation.

It is yet another object of the present invention to provide a propeller assembly for which the propeller blades are easily replaceable.

Summary of the Invention

The variable pitch propeller assembly of the present invention comprises a hollow casing having inner and outer surfaces, with the inner surface disposed so as to fit securely around at least a portion of the outer surface of the propeller shaft. The outer surface of the hollow casing is disposed so as to form the general shape of a cylinder, with the longitudinal axis thereof being defined by the axis of rotation of the propeller's drive shaft. A hollow collar is disposed about the longitudinal axis of the casing so as to synchronously rotate with rotation of the casing. The collar is further configured so as to be movable with respect to the casing along the axis of rotation of the casing. The propeller assembly includes means for moving the collar with respect to the casing along this axis, and a plurality of propeller blades arranged in a spaced-apart relationship around the outer circumference of the casing. Each blade is connected to the casing so as to be rotatable about an axis which extends generally perpendicularly from the outer surface of the casing, at the location where the blade is connected thereto. Each blade is further disposed so that rotational movement of the blade about this perpendicular axis changes the pitch of the blade with respect to the axis of rotation of the casing. The inventive propeller assembly also comprises means for connecting the collar to each of the propeller blades at a location thereon which is radially outward of the outer surface of the casing, with respect to the axis of rotation of the casing. The connecting means is further disposed so that axial movement of the collar with respect to the casing produces the same degree of rotational movement for each blade about its associated perpendicular axis.

In a preferred embodiment, the means for connecting the collar to each of the propeller blades comprises a connecting link for each blade, with each link being disposed so that one end thereof is hingedly attached to the collar and the other end thereof is similarly attached to the blade. One embodiment of the means for moving the collar with respect to the casing comprises a thrust bearing which is connected to the collar, and a hydraulic cylinder which is connected to the thrust bearing by means of a fulcrumed lever. For easy replacement of the propeller blades, they may be attached to the casing by posts which are threadably engaged with the outer surface of the casing. The propeller assembly of the present invention may also include passages along the length of the casing through which the engine's exhaust may be discharged, and means for lubricating the interfaces between the portions of the propeller assembly that are movable with respect to each other.

Brief Description of the Drawings

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

Detailed Description of the Preferred Embodiments

Since the propeller assembly of the present invention is especially useful for adaptation to marine motors, the embodiment of the invention illustrated in the Figures and described hereinbelow is directed to an application of the invention which is useful for outboard motors. However, it is to be understood that the invention is not limited to this application. The principles of operation and structural features of the inventive propeller assembly are equally effective for other applications.

Figure 1:
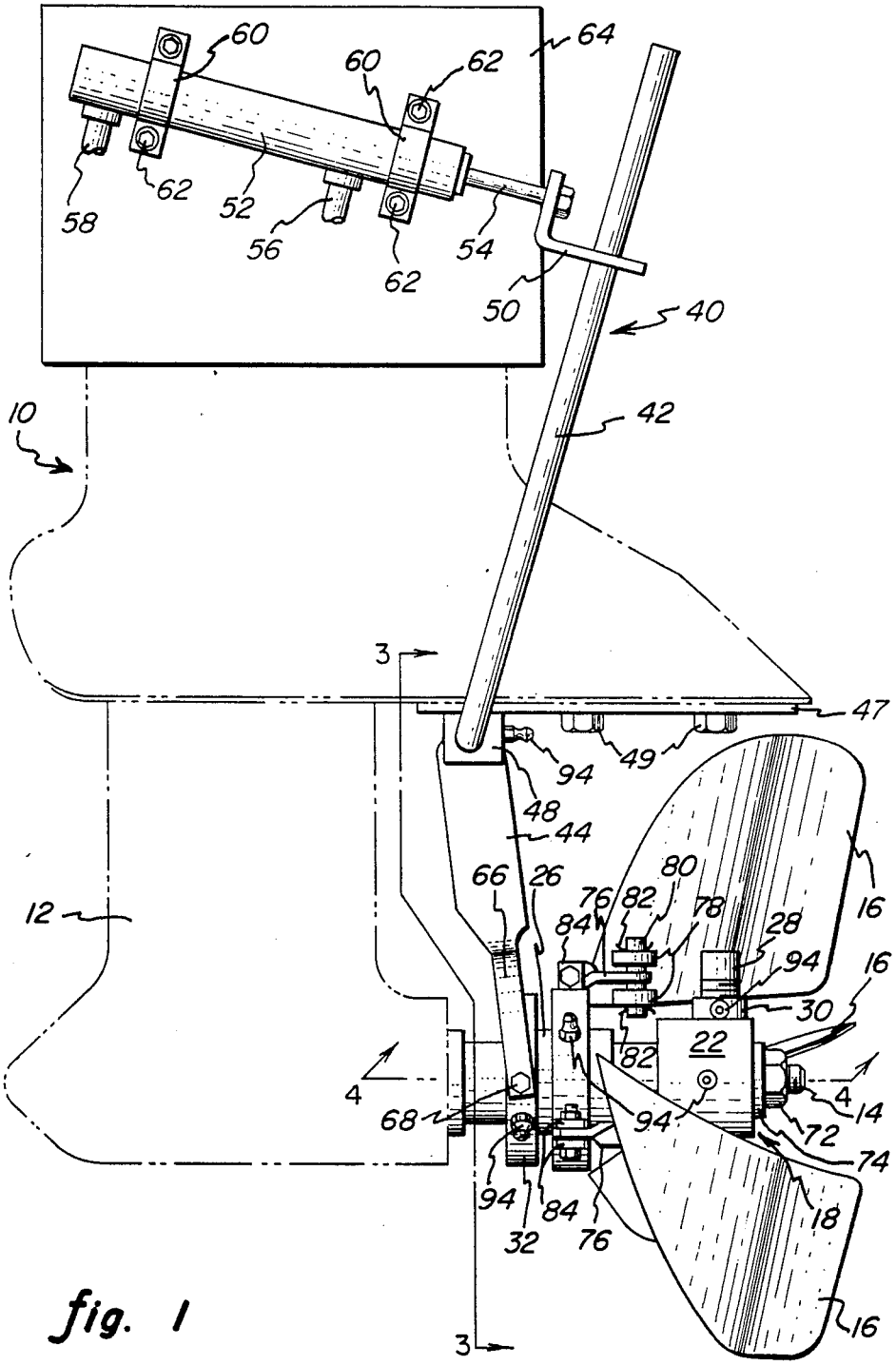
FIG. 1 is a side elevational view schematically illustrating one embodiment of a variable pitch propeller assembly, in accordance with the present invention.

Schematically illustrated in FIG. 1 is lower drive unit 10 of a conventional outboard motor. Enclosed within drive unit housing 12 are conventional drive shafts and gear assemblies for converting power from the engine to rotational motion of propeller drive shaft 14. Propeller blades 16 are configured as part of the propeller assembly of the present invention in such a manner that rotation of propeller shaft 14 produces corresponding rotation of propeller blades 16 about the axis of rotation of shaft 14, and thereby provides propulsion of the motor through the water.

In accordance with the present invention, a variable pitch propeller assembly which can be mounted on a conventional propeller drive shaft, such as propeller shaft 14 shown in FIG. 1, comprises hollow casing 18 having inner surface 20 and outer surface 22. Outer surface 22 is disposed so as to form the general shape of a cylinder, with the longitudinal axis thereof being defined by the axis of rotation of propeller shaft 14. As is better illustrated in FIG. 3, inner surface 20 of casing 18 is disposed so as to fit securely around at least a portion of the outer surface of propeller shaft 14, so as to rotate in synchronism therewith. In the embodiment illustrated in FIGS. 3 and 4, the outer surface of propeller shaft 14 includes splines 24 which extend along at least a portion of the length of shaft 14. Inner surface 20 of casing 18 is disposed so as to define grooves which match splines 24, thereby providing an interlocking mechanism between shaft 14 and casing 18 which prevents rotational movement therebetween. Other structural configurations which provide the function of preventing slippage between shaft 14 and casing 18 may also be utilized, such as, for example, a conventional shear pin which extends through both casing 18 and shaft 14.

Hollow collar 26 is disposed about the longitudinal axis of cylindrically shaped casing 18 so as to synchronously rotate about that axis with rotation of casing 18. Collar 26 is further configured so as to be movable with respect to casing 18 in a direction along the axis of rotation of casing 18. In the embodiment shown in the Figures, the connections between collar 26 and casing 18, via blades 16 and links 76, sufficiently restrain collar 26 from rotational movement with respect to casing 18 that collar 26 and casing 18 rotate in synchronism about propeller shaft 14. In an alternative embodiment to that shown, collar 26 is disposed about the outer surface of a portion of the length of casing 18 so as to be connected to casing 18 by a cam and groove assembly which restrains collar 26 from rotational movement with respect to casing 18. The cam and groove arrangement is further configured to allow movement between collar 26 and casing 18 in a direction along the length of the axis of rotation of casing 18.

A plurality of propeller blades 16 are arranged in a spaced-apart relationship about the outer circumference of casing 18. In the embodiment shown, three such blades are equally spaced about the outermost surface of casing 18 in a conventional fashion. Each blade 16 is connected to casing 18 so as to be rotatable about an axis which extends generally perpendicularly from outer surface 22 of casing 18, at the location on outer surface 22 where blade 16 is connected to casing 18. Blades 16 are further disposed so that rotational movement of each blade about its associated perpendicular axis changes the pitch of the blade with respect to the axis of rotation of casing 18. In the embodiment illustrated, each blade 16 is connected to casing 18 by post 28, one end of which is fixedly attached to blade 16. The other end of post 28 is connected to casing 18 so that post 28 is restrained from movement in a direction along the longitudinal axis of post 28, while simultaneously being rotatable about that axis. Such an arrangement allows blades 16 to rotate about their axes, and thereby change the pitch of the propeller assembly, while also transmitting force from propeller shaft 14 through casing 18 and blades 16 to the water in which the propeller assembly is turning, in order to move the boat forward as the propeller turns.

In the particular embodiment illustrated, post 28 is threadably engaged with correspondingly threaded aperture 30 in outer surface 22 of casing 18. Aperture 30 may be formed as an integral part of outer surface 22 of casing 18, or it may be formed as a threaded opening in a separate component, such as a fastening nut, welded or otherwise attached to surface 22. Post 28 may be mounted to the side of blade 16 in the manner shown in the Figures, or it can be attached to the radially innermost edge of blade 16. Furthermore, post 28 may be fastened to blade 16 by such fabrication methods as welding, or it may be formed as an integral part of blade 16 so that post 28 and blade 16 form a unitary structure. Although not shown in the Figures, post 28 may also include a stop or lip as part of its threaded portion, in order to facilitate correct depth positioning of post 28 in aperture 30.

The propeller assembly of the present invention also comprises means for moving collar 26 with respect to casing 18 along the axis of rotation thereof, and means for connecting collar 26 to each of blades 16 so that axial movement of collar 26 with respect to casing 18 produces the same amount of rotational movement, about the blade's perpendicular axis, for each of blades 16. The connecting means of this invention is further disposed so that collar 26 is connected to each of blades 16 at a location on each blade which is radially outward, with respect to the axis of rotation of casing 18, of the outer surface of casing 18.

Figure 3:
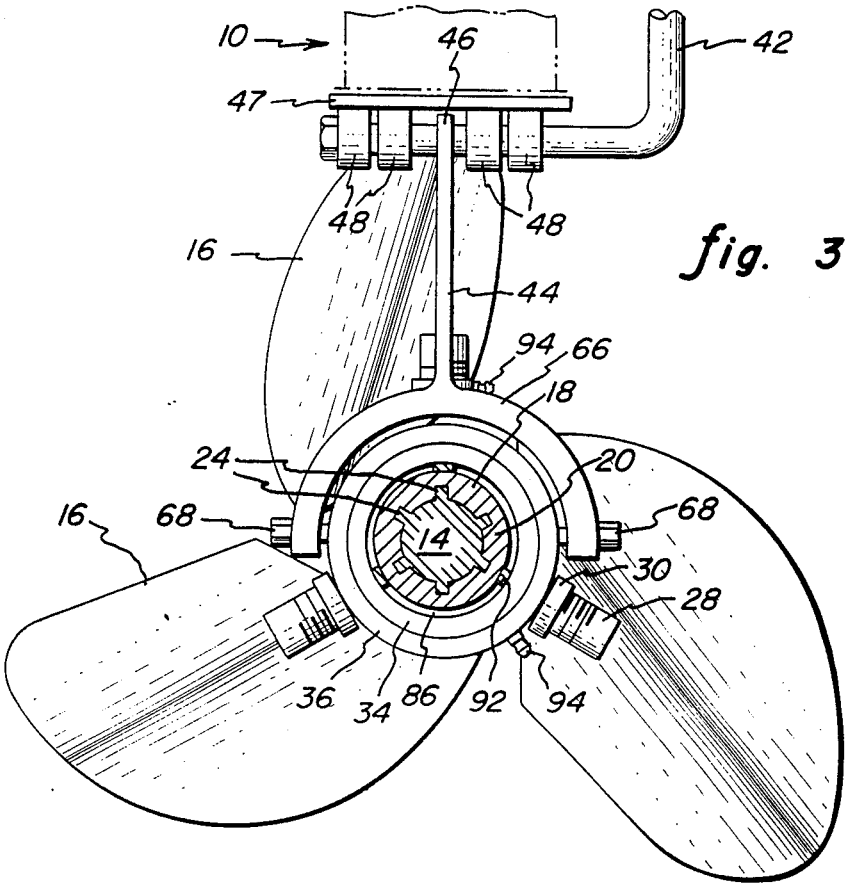
FIG. 3 is an elevational view in partial cross-section of the apparatus shown in FIG. 1, taken along lines 3—3, in which view some of the components shown in FIG. 1 have been omitted for the sake of clarity.
Figure 4:
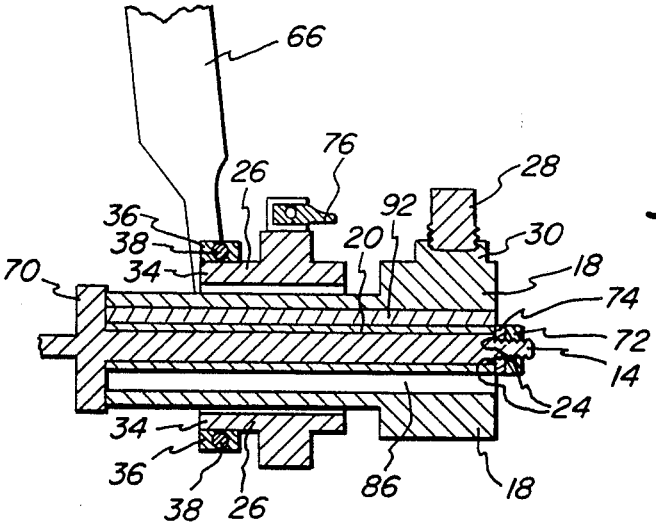
FIG. 4 is a cross-sectional view of a portion of the apparatus shown in FIG. 1, taken along lines 4—4.

In one embodiment, the means for moving collar 26 with respect to casing 18 comprises thrust bearing 32 having inner portion 34 and outer portion 36, in the manner illustrated in FIG. 3. Thrust bearing 32 may comprise a conventional type of structure in which inner portion 34 and outer portion 36 rotate freely with respect to each other. Inner portion 34 of thrust bearing 32 is fixedly attached to collar 26, so that inner portion 34 rotates synchronously with rotation of collar 26. As illustrated in FIG. 4, in one arrangement, inner portion 34 of thrust bearing 32 is formed as an integral part of collar 26. Rotational movement between inner portion 34 and outer portion 36 of thrust bearing 32 is provided by roller bearings 38.

Connected to outer portion 36 of thrust bearing 32 is means for moving thrust bearing 32 and attached collar 26 in a direction along the axis of rotation of collar 26, i.e., along the longitudinal axis of propeller shaft 14. In a preferred embodiment, the means for moving thrust bearing 32 comprises fulcrumed lever 40 having an upper lever portion 42 which is longer than lower lever portion 44. Upper lever portion 42 and lower lever portion 44 are joined together at fulcrum point 46, and the attached levers are hingedly mounted to attachment plate 47 via hinges 48, in the manner illustrated in FIG. 3. Attachment plate 47 is, in turn, mounted to the casing of lower drive unit 10 by fasteners 49. In the resulting arrangement, the greater length of upper lever portion 42 as compared to the length of lower lever portion 44, with reference to fulcrum point 46, provides sufficient mechanical advantage for the force applied to thrust bearing 32 that a relatively small force is needed at bracket 50 in order to produce a relatively large force at thrust bearing 32. Hence, with lever 40 disposed so that lower lever portion 44 is attached to outer portion 36 of thrust bearing 32, and so that upper lever portion 42 is attached to a means for controllably positioning lever 40, relatively little force is needed to move collar 26 in a direction along the length of shaft 14 and, correspondingly, to maintain collar 26 at a particular location with respect to casing 18.

As illustrated in FIG. 1, one means for controllably positioning lever 40 is hydraulic cylinder 52. Cylinder 52 may comprise a conventional type of hydraulic cylinder in which the position of shaft 54 is controlled by hydraulic fluid entering and leaving hydraulic lines 54 and 58. Shaft 56 of cylinder 52 is attached to lever 40 by connecting bracket 50 which is configured so that movement of shaft 54 in the direction of its length produces pivoting movement of lever 40 about fulcrum point 46. Hydraulic cylinder 52 is fastened to mounting plate 64 by mounting brackets 60 which are bolted or otherwise fastened to plate 64 by fasteners 62. Mounting plate 64 is, in turn, attached to the casing for lower drive unit 10 of the motor. The location of mounting plate 64 and attached cylinder 52 are chosen in a given application so that bracket 50 connects to lever 40 at a position along its length which provides sufficient mechanical advantage that the hydraulic cylinder's actuating force is large enough to control the propeller pitch. In the mounting position shown in FIG. 1, hydraulic cylinder 52 and the associated hardware are located above the water level and are thereby removed from the harmful effects that can result from submersion of those components, especially in salt water. If additional protection from the elements is desired, hydraulic cylinder 52 can be mounted inside the casing of lower drive unit 10.

As illustrated in FIG. 3, lower lever portion 44 conveniently includes forked portion 66 for attachment to thrust bearing 32. Forked lever portion 66 is attached to outer portion 36 of thrust bearing 32 by fasteners 68 which pass through apertures in forked lever portion 66. In one embodiment, fasteners 68 comprise screws or bolts which threadably engage outer portion 36 of thrust bearing 32. In an alternative embodiment, fasteners 68 may be attached to a split ring which is clamped together around the exterior of thrust bearing 32.

The cross-sectional view of FIG. 4, in which view blades 16 have not been shown for the sake of simplification, schematically illustrates the arrangement of internal components which facilitates movement of collar 26 with respect to casing 18, along the longitudinal axis of propeller shaft 14. Conventional outboard motor propeller shafts include lip portion 70 against which the propeller assembly is abutted by a retaining force supplied by retaining nut 72 which is threaded to shaft 14. In one embodiment of the propeller assembly of the present invention, retaining nut 72 acts in conjunction with washer 74 to provide a thrust force against one end of inner surface portion 20 of casing 18, which force holds the opposite end of inner surface portion 20 against lip portion 70 of shaft 14. With casing 18 held in position in this manner, and with collar 26 being movable with respect to casing 18, force transmitted by forked lever portion 66 to collar 26, via thrust bearing 32, changes the relative position between collar 26 and casing 18, along the direction of the longitudinal axis of shaft 14.

Referring now to FIG. 1, it is seen that one embodiment of a means for connecting collar 26 to each of blades 16 comprises connecting link 76 for each blade 16. (It should be noted that, for the sake of clarity, the below-described connecting linkage between collar 26 and blades 16 is not shown in FIG. 3.) Link 76 is disposed so that one end thereof is hingedly attached to collar 26 and the other end thereof is hingedly attached to blade 16. In the particular embodiment shown, the hinged attachment of link 76 to blade 16 comprises a pair of generally horizontally extending ears 78, each of which has an aperture defined therein through which pin 80 may be inserted. Pin 80 also extends through an aperture defined in the associated end of link 76, and is held in position by retainer clips 82, which may comprise, for example, cotter pins or circlips. Alternative arrangements for pin 80 include a screw or bolt which threadably engages one of ears 78, or a bolt which passes through both of ears 78 and has a nut fastened thereto. The other end of link 76 may be connected to collar 26 by a similar pair of ears 84 attached to the outer surface of collar 26. Fasteners similar to those described above may be inserted through apertures in ears 84 and through a similar aperture in the associated end of link 76. In the embodiment shown in FIG. 1, ears 84 attached to collar 26 extend in a direction which is generally perpendicular to the direction in which ears 78 attached to blades 16 extend. However, the ears attached to collar 26 could also be formed so that they extend in the same direction as the corresponding ears attached to blades 16.

Connecting links 76 act to translate movement of collar 26 with respect to casing 18, along the longitudinal axis of shaft 14, into rotational movement of each blade 16 about the longitudinal axis of its associated post 28. Hence, actuation of hydraulic cylinder 52, acting through fulcrumed lever 40 and thrust bearing 32, results in a change of pitch between blades 16 and the axis of rotation of shaft 14. As can be seen from FIG. 1, connecting link 76 preferably is attached to blade 16 at a location which is radially outward of the location of the longitudinal axis of blade 16. With the attachment location being offset from the blade's longitudinal axis of rotation in this manner, rotational force applied to blade 16 by link 76 acts through a moment arm which substantially multiplies the applied force. Moreover, with blades 16 being attached to casing 18 by threaded posts 28, and to connecting link 76 by easily removable pins 80, each of blades 16 is separately and easily replaceable in the event it becomes damaged.

Figure 2:
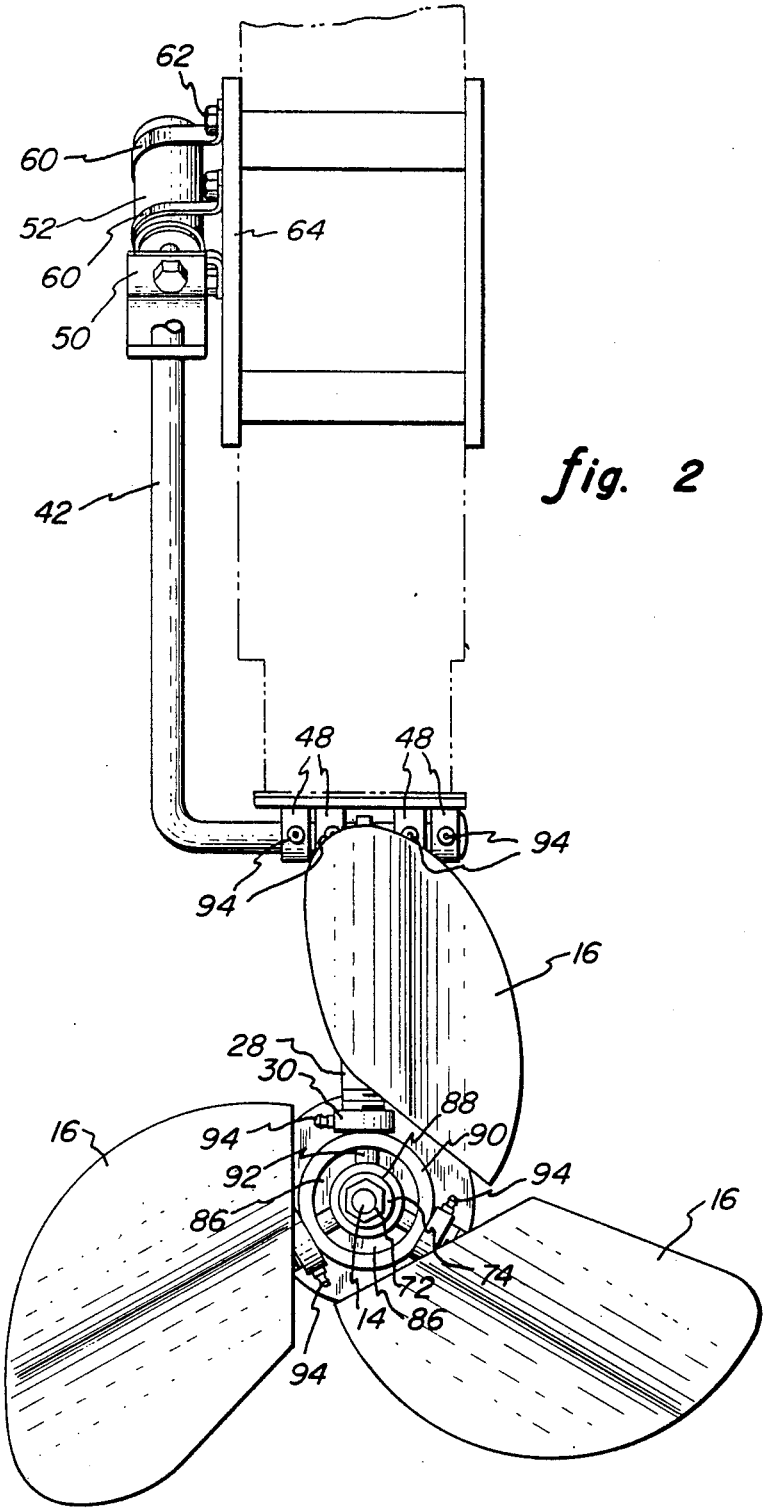
FIG. 2 is a rear elevational view of the variable pitch propeller assembly shown in FIG. 1.

As is best illustrated in FIG. 2, casing 18 may be further configured so as to have defined therein a plurality of passages 86 for discharging exhaust from the power source which provides rotation of drive shaft 14. Passages 86 each extend throughout the length of casing 18 in the direction of the axis of rotation of shaft 14. To provide this function, casing 18 conveniently comprises first member 88 disposed about propeller shaft 14 so that the inner surface of member 88 fits securely around shaft 14. First member 88 is further disposed so that the outer surface thereof forms the general shape of a cylinder. Second member 90, which is configured to have the general shape of a hollow cylinder, is concentrically disposed about propeller shaft 14 with respect to first member 88. Second member 90 is further configured so that the diameter of its inner surface is greater than the diameter of the outer surface of first member 88. A plurality of strut members 92 serve to connect second member 90 to first member 88. Strut members 92 are arranged in a spaced-apart relationship around the outer circumference of first member 88, with each strut member 92 extending between the outer surface of first member 88 and the inner surface of second member 90, in a radial direction with respect to cylindrical members 88 and 90. Strut members 92 are further disposed with respect to each other and with respect to members 88 and 90 so as to define passages 86 therebetween which extend in the direction of the central axis of members 88 and 90, i.e., along the axis of rotation of shaft 14.

Preferably, strut members 92 are formed from elastically deformable material of sufficient resistance to deformation that torque incurred during normal operation of the propeller assembly does not result in rotational movement of member 90 with respect to member 88. The resistance to deformation is sufficiently low, however, that sudden impulses caused by collision or impact of blades 16 against stationary objects results in deformation or even breaking away of struts 92, thereby minimizing the damage to propeller shaft 14 and associated engine components in the event that the propeller assembly strikes a submerged object. It should be noted that, although three equally spaced struts 92 are shown in the Figures, other numbers of struts and spacing arrangements may also be utilized.

Additionally, the propeller assembly of the present invention may further comprise means for lubricating the interfaces between the portions of the propeller assembly that are movable with respect to each other. For example, as shown in the Figures, suitable lubrication fittings 94 may be included in the structural arrangements for collar 26, thrust bearing 32, casing 18, apertures 30, and hinges 48.

The foregoing describes a propeller assembly for which the pitch of the propeller blades may be varied while the propeller is in operation. The present invention provides a variable pitch propeller mechanism which can be readily utilized with conventional marine drive shafts without any significant modifications to the motor's structure or function. The simple design and sturdy construction of the inventive propeller assembly minimize the need for maintenance or repair. This invention provides the further advantage that if one or more of the propeller blades become damaged, the damaged blades may easily and quickly be replaced.

While the invention has been described in detail herein in accord with certain preferred embodiments thereof, many modifications and changes therein may be effected by those skilled in the art. For example, while many of the components of the propeller assembly have been shown in the Figures as comprising metal, and while conventional marine propeller components are typically formed from steel, aluminum, or bronze, other materials which meet the strength and corrosion resistance requirements of a particular application may also be utilized. Also, although the thrust bearing and collar assembly have been illustrated as being located in front of the propeller blades, the principles of the present invention would equally apply to an arrangement in which those components were located in back of the propeller blades. Accordingly, it is intended by the appended claims to cover all such modifications and changes as fall within the true spirit and scope of the invention.

I claim:

1. A variable pitch propeller assembly for mounting on a propeller drive shaft, said propeller assembly comprising:

a hollow casing having inner and outer surfaces, said inner surface being disposed so as to fit securely around at least a portion of the outer surface of said propeller shaft and so as to rotate therewith, and said outer surface being disposed so as to form the general shape of a cylinder, with the longitudinal axis of said cylinder being defined by the axis of rotation of said propeller shaft;

a hollow collar disposed about the longitudinal axis of said cylindrically shaped casing so as to synchronously rotate about said axis with rotation of said casing, said collar being further configured so as to be movable with respect to said casing along said axis of rotation, said collar being connected to said casing by a cam and groove assembly which restrains said collar from rotational movement with respect to said casing, about said axis of rotation of said casing, while simultaneously allowing movement between said collar and said casing in a direction along the length of said axis;

means for moving said collar with respect to said casing along said axis of rotation;

a plurality of propeller blades arranged in a spaced-apart relationship about the outer circumference of said casing, each said blade being connected to said casing so as to be rotatable about an axis which extends generally perpendicularly from the outer surface of said casing at the location where said blade is connected to said casing, each said blade being further disposed so that rotational movement of said blade about said perpendicular axis changes the pitch of said blade with respect to said axis of rotation of said casing; and means for connecting said collar to each of said propeller blades at a location on each said blade which is, with respect to said axis of rotation of said casing, radially outward of the outer surface of said casing, said connecting means being further disposed so that said axial movement of said collar with respect to said casing produces, for each said blade, the same amount of rotational movement about the blade's perpendicular axis.

2. A variable pitch propeller assembly for mounting on a propeller drive shaft, said propeller assembly comprising:

a hollow casing having inner and outer surfaces, said inner surface being disposed so as to fit securely around at least a portion of the outer surface of said propeller shaft and so as to rotate therewith, and said outer surface being disposed so as to form the general shape of a cylinder, with the longitudinal axis of said cylinder being defined by the axis of rotation of said propeller shaft;

a hollow collar disposed about the longitudinal axis of said cylindrically shaped casing so as to synchronously rotate about said axis with rotation of said casing, said collar being further configured so as to be movable with respect to said casing along said axis of rotation;

a thrust bearing for moving said collar with respect to said casing along said axis of rotation, said thrust bearing having inner and outer portions which rotate freely with respect to each other, said thrust bearing being further disposed so that the inner portion thereof is fixedly attached to said collar, so as to rotate synchronously with rotation of said collar; and means, connected to the outer portion of said thrust bearing, for moving said thrust bearing and attached collar in a direction along the axis of rotation of said collar;

a plurality of propeller blades arranged in a spaced-apart relationship about the outer circumference of said casing, each said blade being connected to said casing so as to be rotatable about an axis which extends generally perpendicularly from the outer surface of said casing at the location where said blade is connected to said casing, each said blade being further disposed so that rotational movement of said blade about said perpendicular axis changes the pitch of said blade with respect to said axis of rotation of said casing; and means for connecting said collar to each of said propeller blades at a location on each said blade which is, with respect to said axis of rotation of said casing, radially outward of the outer surface of said casing, said connecting means being further disposed so that said axial movement of said collar with respect to said casing produces, for each said blade, the same amount of rotational movement about the blade's perpendicular axis.

3. The propeller assembly of claim 1 or 2 wherein at least a portion of the outer surface of said propeller shaft is splined, and wherein said casing is further disposed so that the inner surface thereof has defined therein grooves which match said propeller shaft splines.

4. The propeller assembly of claim 1 or 2 wherein said propeller blades are equally spaced about the outer circumference of said casing.

5. The propeller assembly of claim 1 or 2 wherein each said propeller blade is fixedly attached to a post, each said post being connected to said casing so as to be restrained from movement in a direction along the longitudinal axis of said post while simultaneously being rotatable about said longitudinal axis.

6. The propeller assembly of claim 5 where each said post is threadably engaged with a correspondingly threaded aperture formed in the outer surface of said casing.

7. The propeller assembly of claim 5 wherein said post and said propeller blade form a unitary structure.

8. The propeller assembly of claim 1 or 2 wherein said means for connecting said collar to each of said propeller blades comprises a connecting link for each said blade, each said link being disposed so that one end thereof is hingedly attached to said collar and the other end thereof is hingedly attached to said blade.

9. The propeller assembly of claim 8 wherein each said link is attached to the associated blade at a location which is radially outward of the location of said axis of rotation of said blade, so that the combination of said link and said offset radial location where said link connects to said blade forms a moment arm which substantially increases the rotational force applied to said blade by movement of said link.

10. The propeller assembly of claim 2 wherein said means for moving said thrust bearing comprises a fulcrumed lever, said lever being disposed so that one end thereof is attached to the outer portion of said thrust bearing and the other end thereof is attached to means for controllably positioning said lever.

11. The propeller assembly of claim 10 wherein said controllable positioning means comprises a hydraulic cylinder.

12. A variable pitch propeller assembly for mounting on a propeller drive shaft, said propeller assembly comprising a hollow casing having inner and outer surfaces, said inner surface being disposed so as to fit securely around at least a portion of the outer surface of said propeller shaft and so as to rotate therewith, and said outer surface being disposed so as to form the general shape of a cylinder, with the longitudinal axis of said cylinder being defined by the axis of rotation of said propeller shaft, said casing having defined therein a plurality of passages for discharging exhaust from a power source which provides motive force to said drive shaft, each said passage extending throughout the length of said casing in the direction of said axis of rotation of said shaft;

a hollow collar disposed about the longitudinal axis of said cylindrically shaped casing so as to synchronously rotate about said axis with rotation of said casing, said collar being further configured so as to be movable with respect to said casing along said axis of rotation;

means for moving said collar with respect to said casing along said axis of rotation;

a plurality of propeller blades arranged in a spaced-apart relationship about the outer circumference of said casing, each said blade being connected to said casing so as to be rotatable about an axis which extends generally perpendicularly from the outer surface of said casing at the location where said blade is connected to said casing, each said blade being further disposed so that rotational movement of said blade about said perpendicular axis changes the pitch of said blade with respect to said axis of rotation of said casing; and means for connecting said collar to each of said propeller blades at a location on each said blade which is, with respect to said axis of rotation of said casing, radially outward of the outer surface of said casing, said connecting means being further disposed so that said axial movement of said collar with respect to said casing produces, for each said blade, the same amount of rotational movement about the blade's perpendicular axis.

13. The propeller assembly of claim 12 wherein said casing comprises:

a first member disposed about said propeller shaft so that the inner surface of said member fits securely around said shaft, and so that the outer surface thereof forms the general shape of a cylinder;

a second member having the general shape of a hollow cylinder, said second member being concentrically disposed about said propeller shaft with respect to said first member, said second member being further configured so that the diameter of the inner surface thereof is greater than the diameter of the outer surface of said first member; and a plurality of strut members for connecting said second member to said first member, said strut members being arranged in a spaced-apart relationship around the outer circumference of said first member, each said strut member extending between the outer surface of said first member and the inner surface of said second member in a radial direction with respect to said cylindrically shaped first and second members, said strut members being further configured with respect to each other and to said first and second members so as to define passages therebetween which extend in the direction of said axis of rotation of said casing.

14. The propeller assembly of claim 13 wherein said strut members comprise elastically deformable material.

15. A variable pitch having inner and outer surfaces, said inner surface being disposed so as to fit securely around at least a portion of the outer surface of said propeller shaft and so as to rotate therewith, and said outer surface being disposed so as to form the general shape of a cylinder, with the longitudinal axis of said cylinder being defined by the axis of rotation of said propeller shaft;

a hollow collar disposed about the longitudinal axis of said cylindrically shaped casing so as to synchronously rotate about said axis with rotation of said casing, said collar being further configured so as to be movable with respect to said casing along said axis of rotation;

means for moving said collar with respect to said casing along said axis of rotation;

a plurality of propeller blades arranged in a spacedapart relationship about the outer circumference of said casing, each said blade being connected to said casing so as to be rotatable about an axis which extends generally perpendicularly from the outer surface of said casing at the location where said blade is connected to said casing, each said blade being further disposed so that rotational movement of said blade about said perpendicular axis changes the pitch of said blade with respect to said axis of rotation of said casing; and means for connecting said collar to each of said propeller blades at a location on each said blade which is, with respect to said axis of rotation of said casing, radially outward of the outer surface of said casing, said connecting means being further disposed so that said axial movement of said collar with respect to said casing produces, for each said blade, the same amount of rotational movement about the blade's perpendicular axis; and means for lubricating the interfaces between the portions of said propeller assembly that are movable with respect to each other.

16. A variable pitch propeller assembly for mounting on a propeller drive shaft, said propeller assembly comprising:

a hollow casing having inner and outer surfaces, said inner surface being disposed so as to fit securely around at least a portion of the outer surface of said propeller shaft and so as to rotate therewith, and said outer surface being disposed so as to form the general shape of a cylinder, with the longitudinal axis of said cylinder being defined by the axis of rotation of said propeller shaft;

a hollow collar disposed about the longitudinal axis of said cylindrically shaped casing so as to synchronously rotate bout said axis with rotation of said casing, said collar being further configured so as to be movable with respect to said casing along said axis of rotation;

means for moving said collar with respect to said casing along said axis of rotation;

a plurality of propeller blades arranged in a spaced-apart relationship about the outer circumference of said casing, each said blade being connected to said casing so as to be rotatable about an axis which extends generally perpendicularly from the outer surface of said casing at the location where said blade is connected to said casing, each said blade being further disposed so that rotational movement of said blade about said perpendicular axis changes the pitch of said blade with respect to said axis of rotation of said casing; and means for connecting said collar to each of said propeller blades at a location on each said blade which is, with respect to said axis of rotation of said casing, radially outward of the outer surface of said casing, said connecting means comprising a first pair of ears attached to said blade, each said first ear having an aperture defined therein, said first pair of ears being further disposed so that said apertures in said first ears are aligned with each other, a second pair of ears attached to said collar, each said second ear having an aperture defined therein, said second pair of ears being further disposed so that said apertures in said second ears are aligned with each other, a connecting link disposed between said first and second pairs of ears, each end of said link having an aperture defined therein, with said link being further disposed so that the aperture and one end of said link is aligned with the apertures of said first pair of ears, and so that the aperture in the opposite end of said link is aligned with the apertures at said second pair of ears, and for each end of said connecting link, a fastener disposed through said aperture therein and also through the apertures in the associated pair of ears, wherein axial movement of said collar with respect to said casing produces, for each said blade, the same amount of rotational movement about the blade's perpendicular axis.

* * * * *

UNITED STATES PATENT AND TRADEMARK OFFICE

CERTIFICATE OF CORRECTION

PATENT NO. : 4,960,397

DATED : October 2, 1990

INVENTOR(S) : Robert F. Suttmeier

It is certified that error appears in the above-identified patent and that said Letters Patent is hereby corrected as shown below:

Column 10, line 43, insert --:-- after "prising".

Column 10, lines 65 and 66, "spaceda-part" should be "spaced-apart".

Column 11, lines 58 and 59, "spadeda-part" should be "spaced-apart".

Column 12, line 25, "bout" should be "about".

Signed and Sealed this

Twenty-first Day of January, 1992

*Attest:*

HARRY F. MANBECK, JR.

*Attesting Officer*

*Commissioner of Patents and Trademarks*